United States Patent [19]

Rogers, Howard D. et al.

[11] 4,156,355

[45] May 29, 1979

[54] ROW ADVANCING ARRANGEMENT FOR A PROGRAMMABLE FLAT BED KNITTING MACHINE

[75] Inventors: Rogers, Howard D., Musashino, Japan; Henry Schaeflern, Pittstown; John A. Raudonis, Union, both of N.J.

[73] Assignee: The Singer Company, New York, N.Y.

[21] Appl. No.: 935,422

[22] Filed: Aug. 21, 1978

[51] Int. Cl.[2] ..... D04B 7/00

[52] U.S. Cl. ..... 66/75.2

[58] Field of Search ..... 66/75.2, 154 A, 155, 66/60, 64, 50 R

[56] References Cited

U.S. PATENT DOCUMENTS

| | | | |
|---|---|---|---|
| 1,571,765 | 2/1926 | Fels | 66/75.2 |
| 3,035,426 | 5/1962 | MacQueen | 66/76 |
| 3,805,588 | 4/1974 | Protti | 66/154 |
| 3,953,988 | 5/1976 | Gloeckler | 66/75.2 |
| 3,995,453 | 12/1976 | Gloeckler | 66/75.2 |
| 4,079,601 | 3/1978 | Kamikura et al. | 66/75.2 |
| 4,085,597 | 4/1978 | Kamikura et al. | 66/75.2 |
| 4,100,768 | 7/1978 | Kamikura et al. | 66/75.2 |

FOREIGN PATENT DOCUMENTS

| | | | |
|---|---|---|---|
| 2351906 | 4/1975 | Fed. Rep. of Germany | 66/154 A |
| 2364083 | 7/1975 | Fed. Rep. of Germany | 66/75.2 |
| 77256 | 6/1977 | Japan. | |
| 77260 | 6/1977 | Japan. | |
| 80252 | 6/1977 | Japan. | |
| 120748 | 9/1977 | Japan. | |
| 152552 | 12/1977 | Japan. | |

*Primary Examiner*—Ronald Feldbaum

*Attorney, Agent, or Firm*—William V. Ebs; Robert E. Smith; Edward L. Bell

[57] ABSTRACT

An automated flat bed knitting machine including a stationary programmable device with electrical lines corresponding to rows and columns of a fabric producible on the machine is provided with means for extracting information from said device on a row by row basis including switch means operable by the carriage of the machine, motor means controlled by the switch means, and movable contact means controlled by the motor means for sequentially contacting the row lines of the programming device.

6 Claims, 4 Drawing Figures

ROW ADVANCING ARRANGEMENT FOR A PROGRAMMABLE FLAT BED KNITTING MACHINE

DESCRIPTION

1. Field of the Invention

The invention relates to automated knitting machines including a stationary programmable device on which an operator can designate a pattern to be knit into a fabric producible on the machine.

2. Description of the Prior Art

It is known to provide a flat bed knitting machine with a stationary programmable device on which an operator can designate in defined rows and columns a pattern of his own choosing to be knit into a fabric producible on the machine, and it is known to include in the machine means enabling an operator to manually select, either sequentially or otherwise the rows to be knit as a cam carrying carriage is moved across the needle bed of the machine. Such a machine is shown, for example, in U.S. Pat. No. 3,953,988 of Alfred Marcel Gloeckler issued May 4, 1976.

It is a disadvantage of a machine of the described type that the operator has to select rows manually since the operator is inconvenienced, and the selection process is rendered somewhat unreliable by the possibility of human error. It is therefore a prime object of this invention to provide a knitting machine having a stationary programmable device with means for automatically and sequentially selecting rows on the programmable device for reproduction in fabric to be knit on the machine. It is a further object to enable an operator to provide for an automatic reversal in the sequential selection of rows at designated rows on the programmable device of the machine.

SUMMARY OF THE INVENTION

In accordance with the invention, a flat bed knitting machine including a stationary programmable device with electrical row and column lines corresponding to rows and columns of a fabric producible on the machine is provided with means for extracting information from said device on a row by row basis including movable contact means, and motor means responsive to switch means operable by the carriage for moving the contact means into electrical contact with the row lines sequentially as the carriage of the machine completes back and forth knitting movements. Means are provided enabling an operator to predetermine rows on the programmable device between which the motor means is caused to operate first in one direction and then in the opposite direction such that a mirror image of a prescribed design between the said rows may be produced on the machine.

DESCRIPTION OF THE PREFERRED EMBODIMENT

Figure 1:
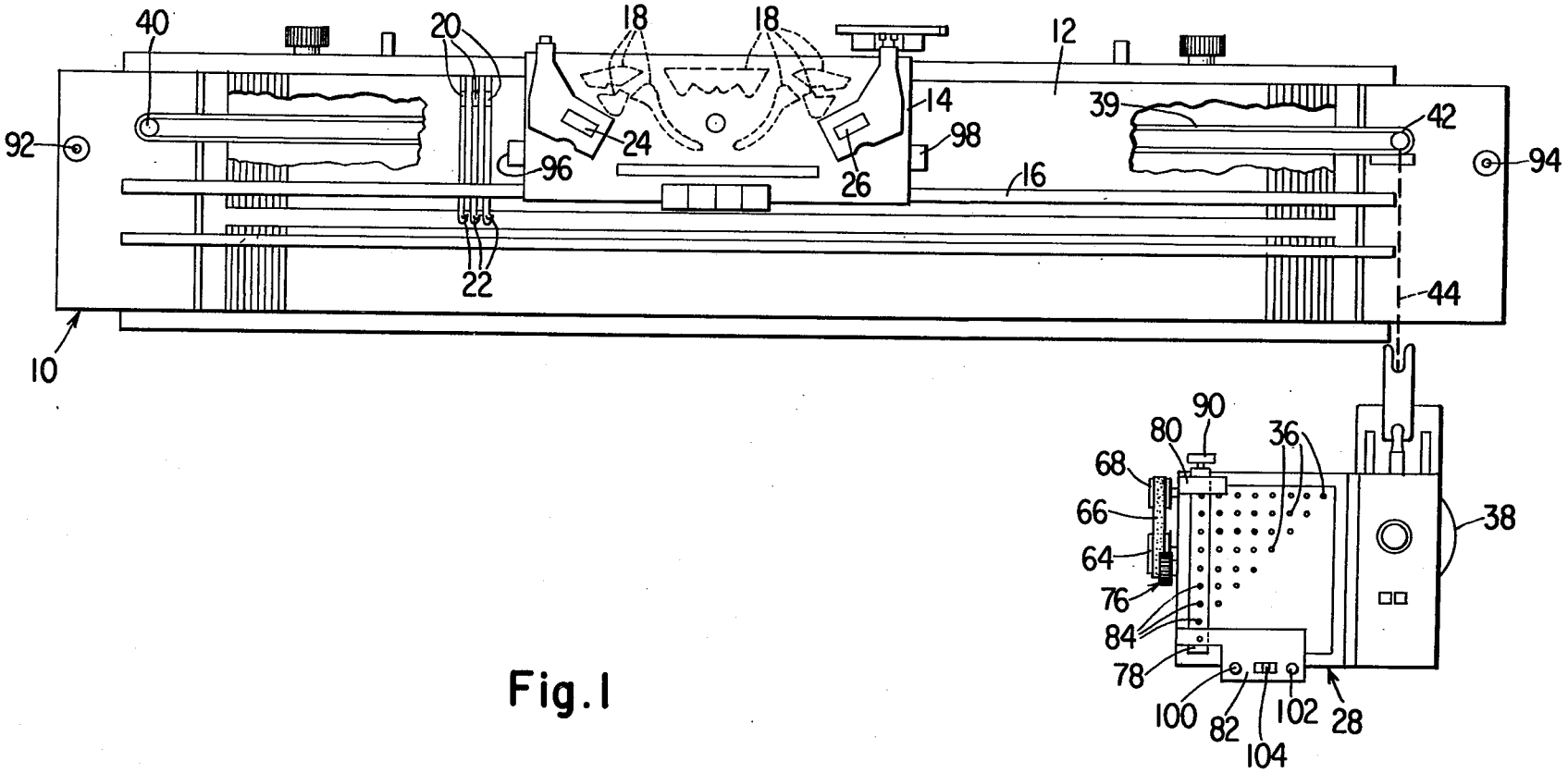
FIG. 1 is a somewhat diagrammatic top plan view of a knitting machine according to the invention.
Figure 2:
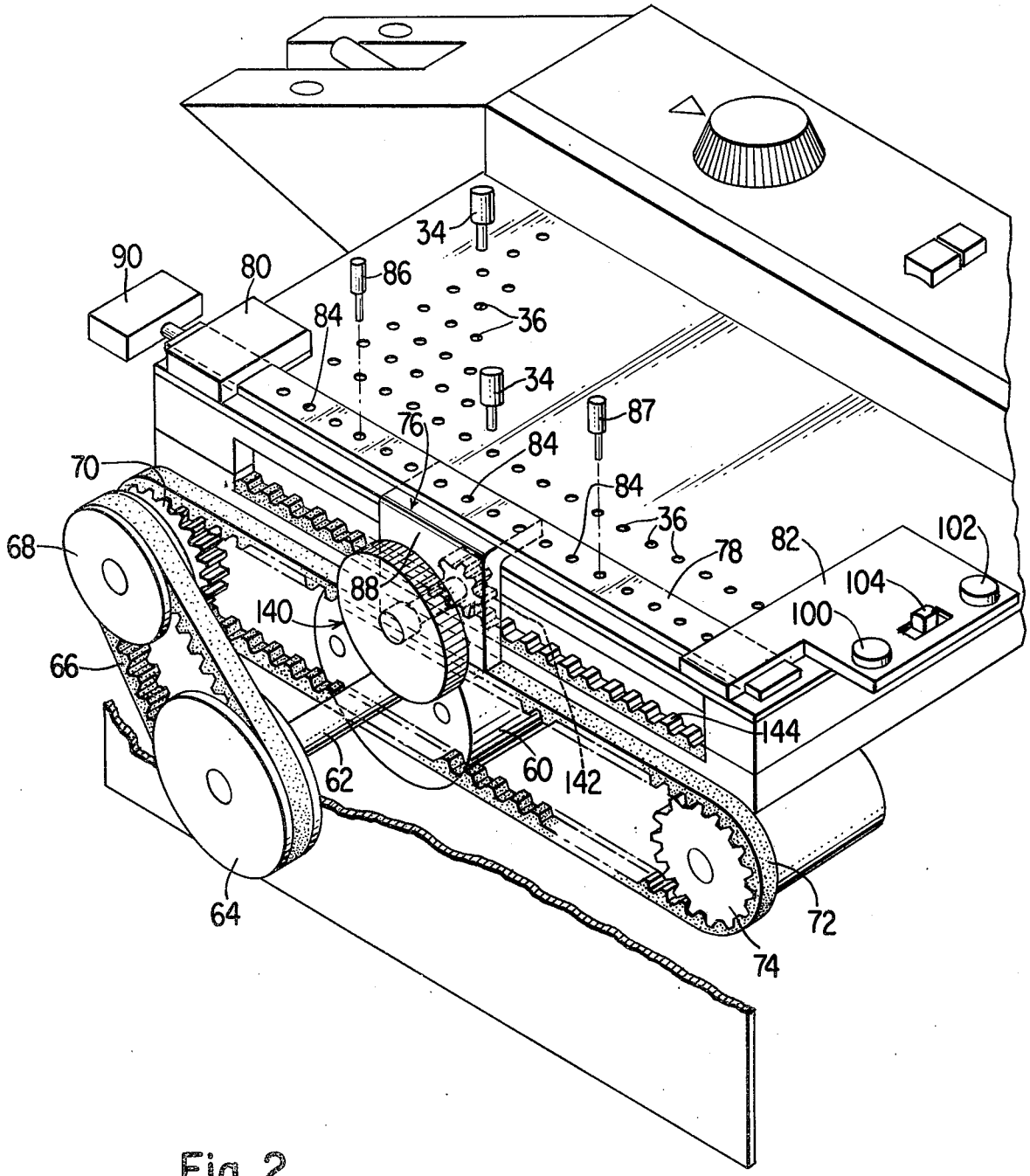
FIG. 2 is an enlarged perspective view showing the programmable device and associated row selector means of the machine.
Figure 3:
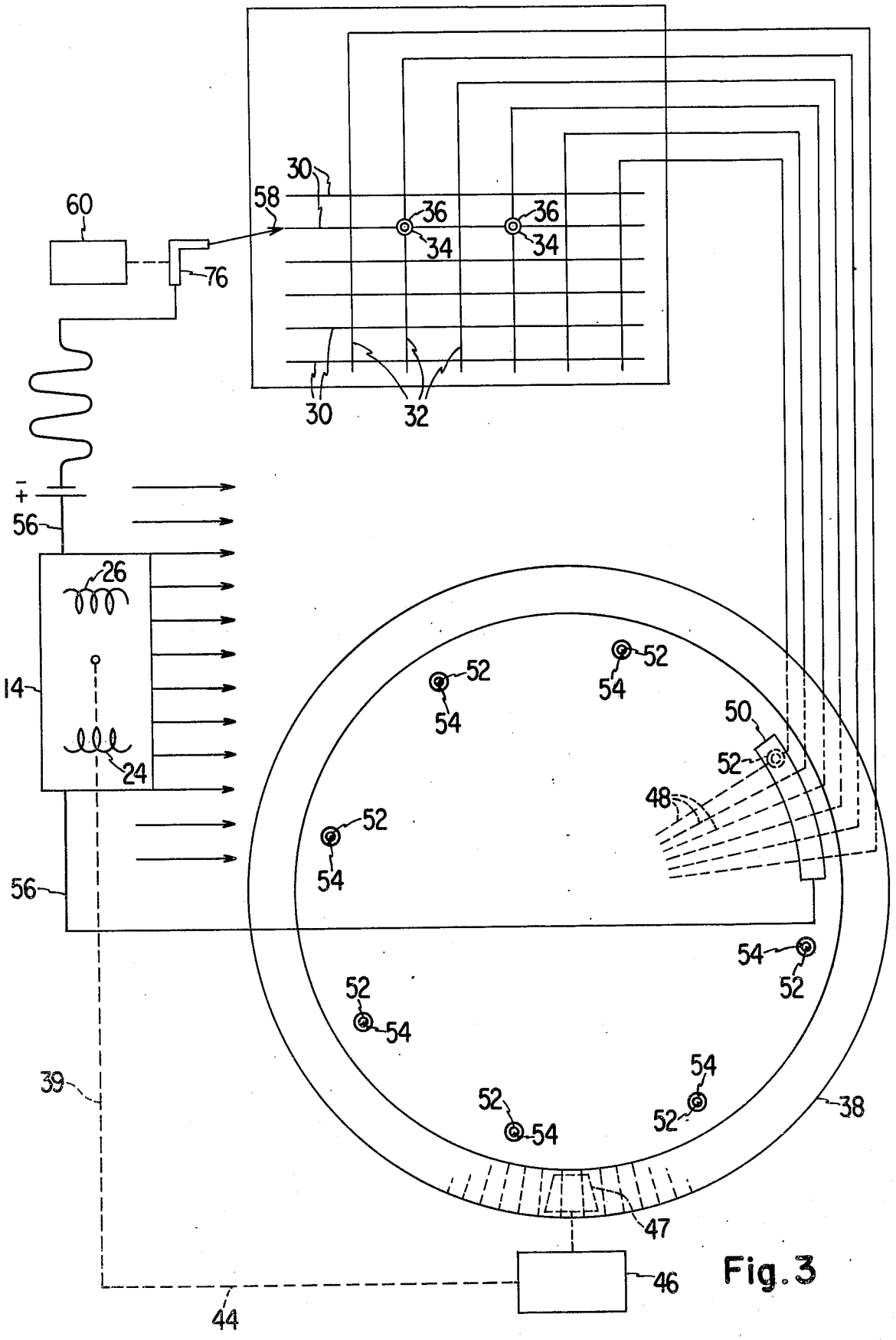
FIG. 3 is a diagrammatic illustration depicting the control circuitry of the programmable device of the machine.

Referring to the drawings and in particular to FIGS. 1, 2 and 3, reference character 10 designates a programmable home type flat bed knitting machine of the kind shown and described in U.S. Pat. No. 3,953,988. As such, the machine includes a needle bed 12, and carriage 14 mounted for sliding motion on a rail 16 which is affixed to the bed 12. The underside of the carriage is provided with cams 18 which interact with the butts 20 of needles 22 causing the needles to be moved transversely in the bed and to knit fabric as the carriage is moved back and forth across the needle bed. Electromagnetic needle selectors 24 and 26 extend through the carriage to interact with needle butts and influence the path of needles through the carriage as required for pattern knitting. Such needle selectors are controlled by a stationary programmable device 28.

The programmable device 28 which is of the kind disclosed in the aforementioned U.S. Pat. No. 3,953,988 and U.S. Pat. No. 3,995,453 issued Dec. 7, 1976 to Alfred Marcel Gloeckler includes electrical row lines 30 and electrical column lines 32 corresponding to rows and columns respectively of knitted fabric producible on the machine. Such electrical row and column lines are subject to being interconnected by pegs 34 which an operator inserts in holes 36 in the device to prescribe a design for reproduction in fabric to be knit as the carriage 14 is moved back and forth across the bed 12.

The carriage 14 is mechanically connected to the disc 38 of an electrical needle selecting device as disclosed in the aforesaid U.S. Pat. No. 3,995,453, that is through a metal band 39 which rides on idler 40 and drives a wheel 42 that in turn acts through shafting 44 and gearing 46, 47 to rotate the disc 38, synchronously with displacement of the carriage. The disc 38 rotates relative to conductors 48 located in fixed positions under the disc, and relative to a conductor strip 50 located over the disc 38. Steel balls 52 which ride in perforations 54 in the disc come into contact the conductor strips 50 and consecutively contact the conductors 48 as the disc 38 is rotated by movement of the carriage. In this way the electrical column lines 32 are consecutively connected to a line 56 which is controlled in a well known manner so that it always connects with the electromagnetic selector 24 or 26 leading in the direction of movement of the carriage 14. The line 56 extends beyond the selectors to movable contact 58 selectively engageable with the row lines 30 and circuits are completed between the selected row line and the column line connected thereto by pegs 34 to cause the design defined by the pegs 34 in the selected row to be knit in a corresponding row of fabric as the carriage 14 is moved in one direction across the bed 12 of the machine. Other rows of a complete design are knit by moving the contact 58 at the end of each stroke of the carriage into engagement with another row line such that the newly selected rows may be knit whenever the carriage direction is reversed.

A stepper motor 60 and motor reversing means are provided to control the movable contact 58 in accordance with the invention. The motor 60 is suitably mounted on programmable device 28 and has its output shaft 62 connected to a wheel 64. The motor drives wheel 64 and the wheel 64 acting through a timing belt 66 drives another wheel 68 and an attached gear 70. Gear 70 drives a timing belt 72 which extends parallel to the side edge of the programmable device and engages an idler gear 74. The belt 72 carries a bracket 76 to which the movable contact 58 is attached.

Programmable device 28 includes an elongated member 78 which is slidable under plates 80 and 82. The member 78 is provided with through holes 84 which extend along its length where they are separated by a distance equal to the distance between holes 36 parallel thereto. Pegs 86 and 87 insertable in the holes 84 are engageable by flange 88 of the bracket 76 and when so engaged the bracket may move member 78 to open or close a switch 90 depending upon the direction in which the bracket is driven by motor 60.

Control circuitry for the motor 60 includes switches 92 and 94 which are located at opposite ends of the carriage and are actuable by fingers 96 and 98 respectively provided on the carriage 14. Such control circuitry also includes the switch 90, manually operable direction switches 100 and 102, and a manually operable on-off switch 104.

Figure 4:
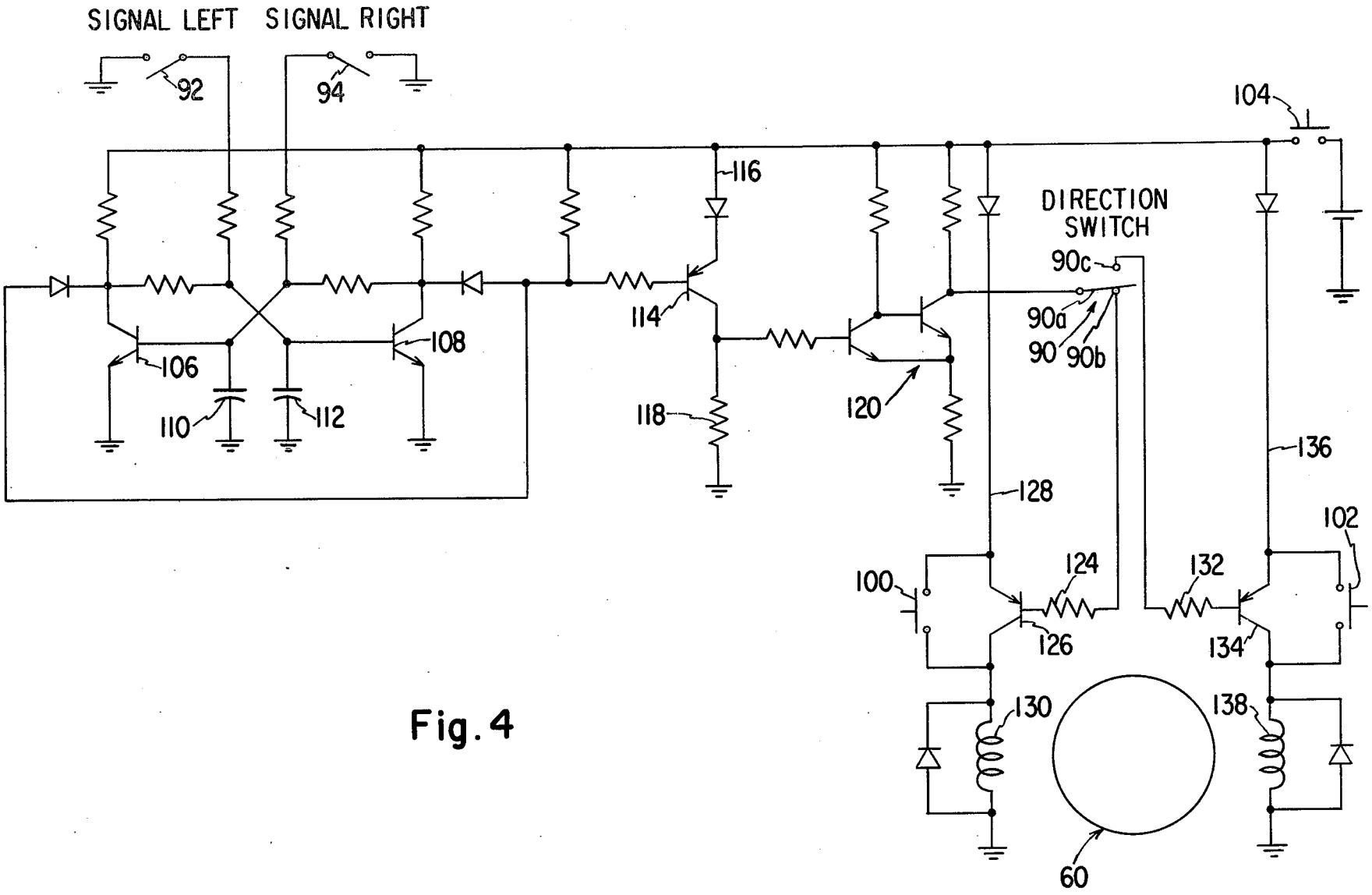
FIG. 4 is a circuit diagram of control circuitry for a stepper motor associated with the programmable device.

The motor control circuitry (see FIG. 4) includes a flip-flop arrangement of transistors 106 and 108 in association with condensers 110 and 112 respectively, and a transistor 114 responsive to the operation of the flip-flop circuitry. The transistor 114 is located in a line 116 which connects on one side of resistor 118 with a two stage amplifier 120 that responds to the voltage in line 116. The amplifier 120 connects with switch 90 having two positions in one of which it connects through resistor 124 with a transistor 126 located in a line 128 that includes coil 130 of the stepper motor 60. In the other position of switch 90 the amplifier connects through resistor 132 with a transistor 134 located in line 136 that includes coil 138 of the stepper motor.

When the carriage is moved back and forth on the machine bed to knit fabric it alternately closes normally open switches 92 and 94 momentarily. With on-off switch 104 closed, condensers 110 and 112 are charged, and when switch 92 is closed by the carriage as it is moved into the far left position condenser 112 is caused to discharge and alter the voltage at the base of transistor 108 the result of which is that line 116 becomes conductive and sends a signal to amplifier 120. The output of the amplifier 120 (with switch 90 in the position indicated in the drawing) renders transistor 126 and line 128 conductive to result in a pulse of current in motor coil 130 and operation of the motor 60 in the direction required to step movable contact 58 upward one row line from an initially selected row line (selected as for example with hand wheel 140 which is rotatable in bracket 76 and can be turned to move an associated gear 142 along rach 144.)

Switch 92 opens when the carriage is moved to the right on the machine bed and condenser 112 recharges. As the carriage is moved into a far right position, switch 94 closes, and condenser 110 is caused to discharge and alter the voltage at the base of transistor 106 whereupon line 116 is caused to conduct and send a signal to amplifier 120. The output of the amplifier causes transistor 126 and line 128 to conduct. Motor coil 130 is energized by a pulse of current and motor 60 is operated to step contact 58 through another row line upwardly on the programming device.

Switch 94 opens as the carriage is moved toward the left on the machine bed and condenser 110 recharges. Repeated traverses of the carriage across the bed of the machine results in repeated step advances of contact 58 upward through the row lines, and row by row knitting as indicated on the programming device. After a programmed design has been knit the operator may move contact 58 downwardly with wheel 140 to the initially selected row and once again knit the programmed design in additional rows of fabric.

Pegs 86 and 87 when positioned in holes 84 opposite selected rows which bracket a programmed design cause the motor to be operated in such fashion as to result in the repeated formation of such design and its mirror image on the machine as the carriage is moved back and forth across the machine bed. With motor 60 operating to step contact 58 upwardly as described in response to closure of contacts 92 and 94 peg 86 is eventually engaged by bracket 76 and the bracket acting through the peg and member 78 repositions switch 90 by moving the switch arm **90*a* from contact 90*b* to contact 90*c*. After the switch has been so repositioned, transistor 134 and line 136 are rendered conductive by the closure of switch 92 or 94. Motor coil 138 is energized thereby and the motor 60 is operated to step contact 58 downwardly. The downward stepping of the contact is repeated with repeated traverses of the carriage until the bracket engages peg 87 and causes elongated plate 78 to once again reposition switch 90 whereupon transistor 126 and line 128 become operative and the operating direction of the step motor in response to traverses of the carriage is again reversed. As a consequence of the motor reversals the machine alternates between knitting the rows between the pegs 86 and 87** in one direction and in the opposite direction.

An operator can cause the motor 60 to be operated independently of carriage movement and of the position of switch 90 in whichever direction he may choose to select a programmed row on device 28 for reproduction on the machine. If the operator repeatedly depresses switch 100 the motor steps contact 58 sequentially upward through the row lines, and if he repeatedly depresses switch 102 the motor steps contact 58 downwardly.

Although only a particular preferred embodiment of the invention has been shown and described by way of illustration, various modifications will occur to those skilled in the art, and it is, therefore to be understood that it is intended herein to cover all such modifications as fall within the true spirit and scope of the invention.

What we claim is:

1. A knitting machine comprising a carriage slidable on a needle supporting flat bed, the carriage including electromagnetic needle selecting means, a stationary programmable device including electrical lines corresponding to rows and columns in a fabric producible on the machine, means for connecting the row and column lines at selected points defining a pattern to be produced on the machine, movable contact means, means for moving the contact means into electrical contact with the row lines sequentially including motor means operably connected to the movable contact means and switch means actuable as the carriage completes its knitting movements for initiating operation of the motor means, and circuit means operable in synchronism with movement of the carriage relative to needles in the bed, such circuit means being connected with the movable contact means and with the said row and column lines for providing the electromagnetic needle selecting means with pattern control signals resulting in the reproduction in a row of fabric produced on the machine of the pattern defined in the contacted row line.

2. A knitting machine as defined in claim 1 including circuitry for reversing the operating direction of the motor means and thereby the order in which row lines are contacted by the movable contact means.

3. A knitting machine as defined in claim 2 wherein the reversing circuitry includes manually controllable switch means.

4. A knitting machine as defined in claim 2 wherein the reversing circuitry includes contact means, and the machine includes a first member movable by the motor means and a second member actuable in response to movement of the first member upon the attainment by the first member of defined positions predetermined by an operator, the second member being effective when actuated by the first member to operate said contact means.

5. The combination of claim 4 wherein the first member is moved linearly by the motor means and the second member is mounted for sliding movement on the programmable device.

6. The combination of claim 5 wherein the defined positions are predetermined by pegs positionable on the second member for engagement by the first member.

* * * * *